United States Patent [19]

Volz et al.

[11] 4,070,520

[45] Jan. 24, 1978

[54] FABRIC SOFTENER COMPOSITION

[75] Inventors: Robert Andrew Volz, West Chester, Pa.; Robert Eugene Welsh, Claymont, Del.

[73] Assignee: Scott Paper Company, Philadelphia, Pa.

[21] Appl. No.: 720,268

[22] Filed: Sept. 3, 1976

[51] Int. Cl.[2] ..... B05D 5/00; B05D 3/12

[52] U.S. Cl. ..... 428/311; 427/244; 427/276; 427/365

[58] Field of Search ..... 427/271, 275, 170, 278, 427/439, 276, 434, 243, 244, 365, 366, 369, 370; 252/8.6; 428/311; 118/60

[56] References Cited

U.S. PATENT DOCUMENTS

| | | | |
|---|---|---|---|
| 2,649,386 | 8/1953 | Snowman, Jr. | 427/278 X |
| 3,442,692 | 5/1969 | Gaiser | 427/240 |
| 3,551,186 | 12/1970 | Martin et al. | 427/366 X |
| 3,632,396 | 1/1972 | Zamora | 252/8.6 X |
| 3,686,025 | 8/1972 | Morton | 428/219 |

*Primary Examiner*—Morris Kaplan

*Attorney, Agent, or Firm*—Nicholas J. DeBenedictis; John W. Kane

[57] ABSTRACT

Heat activated, fabric conditioning products comprising a thick, absorbent substrate impregnated with fabric-conditioner chemicals are suitable for use at elevated temperatures encountered in laundry dryers. Prior to being used, such products tend to be stiff and boardy because of the brittle, wax-like properties of the fabric conditioner chemicals at ambient temperature. The stiff, boardy properties are substantially eliminated by temporarily compressing the thick impregnated substrate to less than 70% of its original thickness.

13 Claims, 1 Drawing Figure

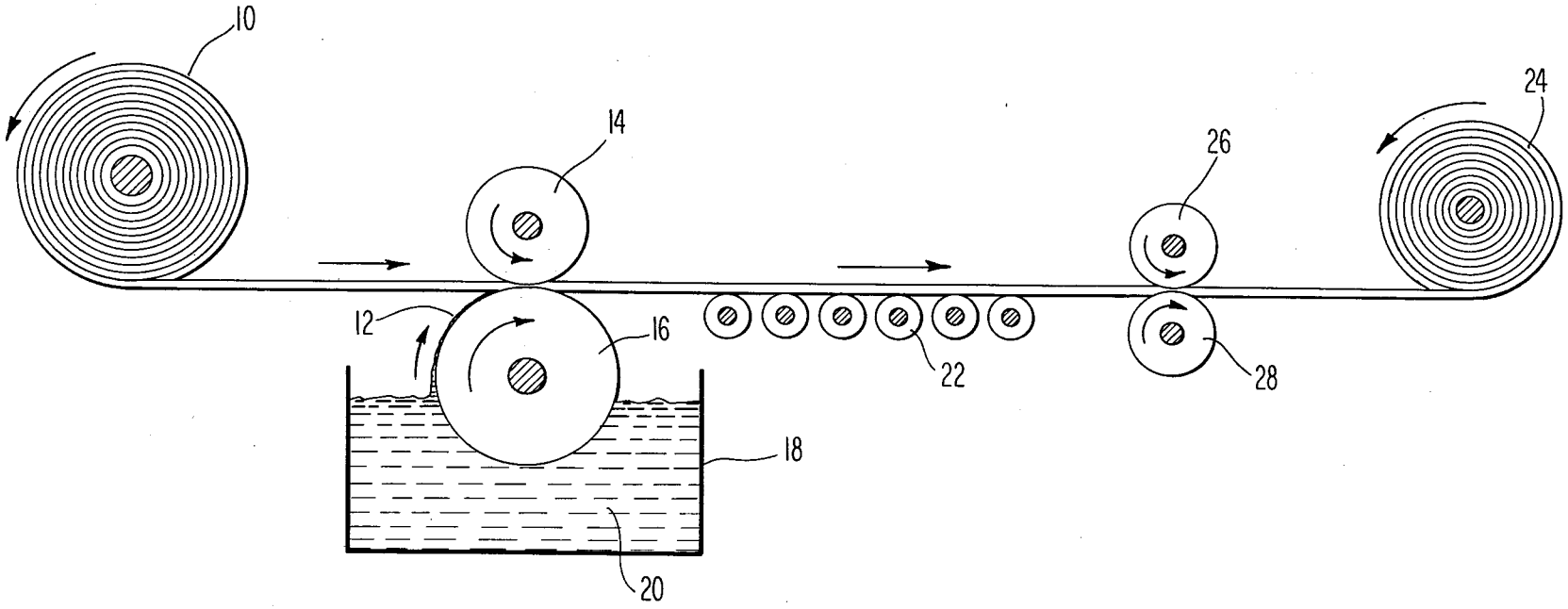
10
12
14
16
18
20
22
24
26
28

FABRIC SOFTENER COMPOSITION

BACKGROUND OF THE INVENTION

1. Field of the Invention

This invention relates to fabric-softening products suitable for use at elevated temperatures encountered in laundry dryers. In particular the invention relates to eliminating the rigidity imparted to the substrate by the fabric softening agents.

2. Description of the Prior Art

Surface modification of fabrics, particularly cellulosic fabrics, to soften and impart properties such as antistatic, lubricating, bacteriostatic, mildew-proof and moth-proof properties has been accomplished by treating the fabrics with appropriate chemicals for modifying such properties. It is now common practice to treat various types of household apparel and fabrics such as wool, cotton, and synthetics such as polyester or nylon, with one or more specialized conditioning agents which affect the For various beneficial reasons, the practice has recently developed of softening and otherwise conditioning household apparel and fabrics during drying of the fabrics after laundering. Fabric conditioning products comprising sheet goods (substrate) coated or impregnated with a fabric-softening chemical and/or other specialized fabric conditioning chemicals have been commingled with damp laundry during the drying of the laundry at the elevated temperatures encountered in a typical household laundry dryer. The elevated temperatures encountered during drying releases the specialized fabric conditioning chemicals which are transferred to the commingled fabrics during drying.

Typical absorbent sheet goods employed as a substrate for heat-activated, fabric-softening products include flexible foam, felted, non-woven, air-lay and wet-lay fibrous sheets such as paper toweling, skrims, cloth, and air-lay webs composed of cellulosic or synthetic fibers of papermaking-length or longer. For example see U.S. Pat. No. 3,442,692 entitled METHOD OF CONDITIONING FABRICS.

Fabric-softening chemicals and other specialized chemicals for conditioning fabrics have been coated onto or impregnated into such absorbent substrates. Preferably, to avoid staining and other problems during drying, the conditioning chemicals have been impregnated into the absorbent substrate in combination with controlling the absorbent characteristics of the substrate. For example see U.S. Pat. No. 3,686,025 entitled TEXTILE SOFTENING AGENTS IMPREGNATED INTO ABSORBENT MATERIALS.

The fabric conditioner chemical is applied to the absorbent substrate in liquid form (a molten bath or a solution made with a solvent) and then solidified (by cooling or evaporating the solvent). The absorbent substrate with the solidified fabric conditioner impregnated into the substrate is stiff and boardy due to the solidified fabric conditioner even if the substrate was soft and flexible prior to being impregnated.

SUMMARY OF THE INVENTION

Temporarily compressing a thick, absorbent substrate having a solidified fabric conditioner chemical impregnated therein produces a softer, more flexible impregnated substrate. The compressing should reduce the thickness of the substrate to less than 70% of its original thickness. The substrate usually returns to substantially its original thickness shortly after the compressive forces are released.

BRIEF DESCRIPTION OF THE DRAWING

The FIGURE of drawing schematically depicts the manufacture of a heat activatable, fabric conditioning product and the subsequent compressing of the product.

DETAILED DESCRIPTION OF THE INVENTION AND EMBODIMENT

Absorbent substrates suitable for use in the present invention should have a thickness of at least about 0.05 centimeters and substantial "free space" or "void volume." Examples of suitable substrates are absorbent sponges such as flexible foams, non-woven fabrics such as multi-ply paper, heavy basis weight paper, felted fabrics and knitted or woven bulky fabrics.

The free space of substrates can be defined in terms of the absorbent capacity determined according to a standard test. A test for determining absorbent capacity of thick paper, foam or cloth substrates in U.S. Federal Specifications UU-T-595b modified as follows:

1. Tap water is used instead of distilled water;
2. The specimen is immersed for 30 seconds instead of 3 minutes;
3. Draining time is 15 seconds instead of 1 minute; and
4. The specimen is immediately weighted on a balance scale having a pan with turned-up edges.

Thick paper products (having a basis weight of greater than about 100 pounds per 3,000 sq. ft. and a thickness greater than about 1/16 inch) have an absorbent capacity value as determined by the above test of greater than about 6.0 and are suitable for use in the present invention.

Absorbent substrates impregnated with a heat-softenable, fabric-conditioner are well known and will be referred to hereinafter as heat-activatable fabric conditioning products and also as "impregnated substrate."

An impregnated substrate can be prepared with one or more fabric conditioning chemicals which may be mixed with other various optional additives such as anti-static agents and perfumes. Usually, the amount of fabric conditioning chemicals impregnated into the substrate will be from about 0.3 to about 0.7 grams per cubic centimeter of unimpregnated substrate.

The substrate is usually in the form of a long, wide sheet having a thickness of at least about 0.05 centimeters and preferably a thickness of about 0.25 centimeters. The minimum thickness of the substrate is significant since impregnating the material with a liquid fabric conditioning agent that is subsequently solidified at ambient conditions gives the substrate material a rigid, boardy-like character due to reinforcing of the substrate by the solidified fabric-conditioning agent. Very thin substrates would still be somewhat flexible. Accordingly, the function of the present invention is applicable to substrates having a significant thickness of at least about 0.15 centimeters.

The preferred substrate is flexible foam sheet material having a void volume of greater than about 80% (preferably greater than about 95%) and a thickness of greater than about 0.05 centimeters. A void volume of greater than about 80% correlates approximately with an absorbent capacity value as determined by the above test of greater than about 10. Preferred foam sheet material is flexible, polyether-based, polyurethane foam having a thickness of about 0.25 centimeters and a pore size in the range of from about 10 pores per inch to about 100 pores per inch. While woven, nonwoven or knitted cloth fabrics are suitable, they are not preferred in practicing the present invention.

Handling, finishing and packaging of thick, heat-activatable fabric conditioning products produces substantial quantities of dust caused by the breaking off of small particles of solidified fabric conditioning chemicals. Temporarily compressing the impregnated substrate to less than about 70% of its original thickness renders the product very soft and fabric-like to the feel as compared to the stiff, boardy properties of the product prior to being compressed.

Heat-activatable fabric conditioning products of the type softened by the present invention are produced by impregnating a suitable substrate with liquid fabric conditioning composition followed by solidifying the composition in the substrate. Impregnation is accomplished by contacting the substrate with the liquid fabric conditioning composition, squeezing the substrate and allowing the substrate to expand in the presence of the liquid. Preferably the fabric conditioner is liquified by being held at an elevated temperature above the melting point of the fabric conditioning composition. Alternatively, solvents can be used to liquify the fabric conditioner chemicals.

When the hot-melt technique is used, the impregnated substrate is cooled to solidify the fabric conditioning composition or the substrate. When a solvent system is employed, the solvent is evaporated sufficiently to solidify the fabric conditioning composition.

After solidification of the fabric conditioning chemical, the impregnated substrate is temporarily compressed to 70% or less of its original thickness. When the compressive forces are relieved, the resulting impregnated substrate is softer and more fabric like to the feel. Significantly, a subtle color change occurred on the surfaces of the impregnated product.

Fabric conditioning chemicals and mixtures thereof suitable for use in heat-activatable fabric conditioning products are well known and disclosed in U.S. Pat. No. 3,442,692 issued to C. J. Gaiser on May 6, 1969, entitled METHOD OF CONDITIONING FABRICS at column 3, line 7 to column 4, line 24 which disclosure is incorporated herein by reference with respect to its teachings of suitable fabric conditioning chemical compositions. U.S. Pat. No. 3,632,396 issued on Jan. 4, 1972 entitled DRYER-ADDED FABRIC-SOFTENING COMPOSITION discloses suitable heat-activated fabric softening compositions at column 7, line 70 to column 12, line 73 which disclosure is also incorporated herein by reference with respect to its teachings of heat-activatable fabric softening and conditioning chemicals. Suitable compositions are also disclosed in U.S. Pat. Nos. 3,686,025; 3,870,145 and 3,895,128. Usually, from about 2 to 10 ounces of active ingredients (fabric conditioner chemical) are impregnated per square yard of substrate with about 4 ozs. per square yard being preferred.

Heat-activated fabric conditioning products and methods of producing such products with thick absorbent substrates are disclosed in U.S. Pat. No. 3,686,025 issued to D. R. Morton entitled TEXTILE SOFTENING AGENTS IMPREGNATED INTO ABSORBENT MATERIALS. The Morton patent discloses sponges, multi-ply paper and non-woven cloth as suitable substrates. Suitable fabric softening compositions are disclosed in the Morton patent at column 5, line 51 to column 14, line 34 which disclosure is incorporate herein by reference.

The process of the present invention for compressing a heatactivated fabric conditioning product can be best understood with reference to the drawing. The drawing shows a manufacturing process and a post compressing of the product to soften the product. Suitable absorbent substrate, 10, passes through the nip of mating rollers 14 and 16 where it is compressed in the presence of molten fabric conditioning composition, 12, which causes impregnation of the molten fabric conditioning composition into the substrate 10. The Molten fabric conditioning composition (composed of one or more heat-activatable fabric conditioner chemicals along with any other desired additives such as perfumes or solvents) is supplied to the nip by lower roller 16 which is partially immersed in a molten bath 20, contained in heated tank 18. The impregnated substrate expands as it leaves the nip of rollers 14 and 16 which completes the impregnating process. The impregnated product passes over rollers 22 where solidification of the impregnant occurs as the impregnated substrate cools to ambient temperatures. The substrate with the solidified fabric softener composition then passes through the nip of rollers 26 and 28. The gap between rollers 26 and 28 is preset for compressing the substrate to 70% or less of its original thickness. The substrate leaves the nip of compressive rollers 26 and 28 and regains substantially all of its original thickness due to the release of the compressive forces. At this point the essential steps of the process have been performed and the heat-activatable fabric conditioning product, 24, is softer and more flexible. However, dusting occurs when the product passes through rollers 26 and 28.

In practicing the present invention, the compression of the heat-activatable fabric conditioning product should be sufficient to reduce the thickness of the product by 30% or more, however the duration of the compression or duration of the thickness reduction are not critical. For example, a foam substrate having a thickness of 0.5 centimeters should be compressed to a thickness of 0.35 centimeters or less in order to make the composition less brittle and reduce its dusting tendency during subsequent handling and finishing. After release of the compressive forces, most foam substrates regain substantially all of their original thickness within a few minutes. Whether or not the original thickness is completely regained is not critical since the benefits imparted by the present invention are present even if the product does not regain all of its original thickness.

Compression of the heat-activatable fabric conditioning product is performed at ambient temperature.

The following examples demonstrate the process and the improved heat-activatable fabric conditioning product produced by the process. All proportions stated herein are by weight unless otherwise indicated.

EXAMPLE I

A fine cell (approximately 80 pores per inch), flexible, polyether based, polyurethane foam having a density of about 1.4 pounds per cubic foot and a thickness of about 0.085 inches was impregnated with a molten fabric conditioning composition comprising 84.8% by weight Varisoft® 137 and 15.2% by weight Varonic® 485. Three samples (A, B and C) were impregnated with different levels of chemicals, (A with 3.0 ounces of impregnate per square yard of foam substrate, B with 5.0 ounces per square yard of substrate and C with 7.0 ounces per square yard of substrate). Each of the samples were compressed to less than 70% of its original thickness of 0.085 inches by passing the sheet of impregnated foam through a nip produced by mating rollers. After the impregnated foam passed through the rollers, the foam had substantially improved softness and fabric-like properties.

Each of the samples above were made with a light blue colored foam substrate. After impregnating with the fabric conditioning composition, the impregnated product had a color altered by the presence of the conditioning composition. After being compressed, a subtle color change occurred giving the compressed portions of the resulting product a different color shade closer to the original light blue color of the foam substrate.

EXAMPLE II

Portions of an impregnated foam sample identical to Sample A of Example I were compressed to less than 70% of their original thickness. The resulting product had a pattern printed on it corresponding to the compressed portions because of a difference in color tone between the compressed and uncompressed portions. This produced a decorative effect by which a printed pattern containing regular shapes such as letters, words and fanciful configurations can be reproduced upon the impregnated fabric conditioning product. The regular shapes can be the compressed or uncompressed portions of the heat-activatable fabric conditioning product. In order to maximize the benefits obtained by compressing the product and still have two color tones, the compressed portions should constitute at least about 80% of the product. "Not compressed" as the term is used herein refers to less than 30% compression.

Varisoft® 137 is a dialkyl dimethyl quaternary fabric softening chemical obtainable from Ashland Chemical Company and is defined chemically as dihydrogenated-tallow dimethyl ammonium methyl sulfate having a melting point of 138° C and a molecular weight of about 645.

Varonic® 485 is a nonionic fabric conditioning chemical obtainable from Ashland Chemical Company and is believed to be a nonionic modified glyceryl monosterate having a HLB value of about 8.4.

The blend of Varisoft 137 and Varonic 485 employed in Example I was diluted with about 6% isopropanol and had a melting point of about 50° C.

What is claimed is:

1. In the method of manufacturing a heat-activatable fabric conditioning product comprising impregnating an absorbent substrate having a thickness of at least 0.05 centimeters with at least 0.3 grams per cubic centimeter of a liquid fabric conditioning chemical followed by solidifying the fabric conditioning chemical on the substrate, the improvement which comprises;

subjecting the absorbent substrate having the solidified fabric conditioning chemical impregnated therein to a compressive force of sufficient magnitude to reduce the thickness of the impregnated substrate to about 70% or less than 70% of its original thickness followed by relieving the compressive forces.

2. The method of claim 1 wherein the absorbent substrate is a flexible polyurethane foam.

3. The method of claim 1 wherein the absorbent substrate is a flexible, polyether-based polyurethane foam having a cellular size in the range of from 10 pores per inch to 100 pores per inch and having a void volume of at least about 80%.

4. The method of claim 1 wherein the amount of fabric conditioning chemical impregnated into the absorbent substrate is from about 2 ounces per square yard of absorbent substrate to about 10 ounces per square yard.

5. The improved heat-activatable fabric conditioning product produced by the process of claim 1.

6. The improved heat-activatable fabric conditioning product produced by the process of claim 2.

7. The improved heat-activatable fabric conditioning product produced by the process of claim 3.

8. The method of claim 1 wherein the compressive force is limited to a portion of the absorbent substrate to produce a heat-activatable fabric conditioning product having two distinct color tones.

9. The method of claim 8 wherein the compressed portion comprises a printed pattern of predetermined regular shapes.

10. The method of claim 9 wherein the predetermined regular shapes are letters.

11. The method of claim 8 wherein the noncompressed portion comprises a predetermined regular pattern and the compressed portion constitutes at least about 80% of the product.

12. The method of claim 11 wherein the predetermined regular pattern is composed of letters.

13. The heat-activatable fabric softener product produced according to the method of claim 11.

* * * * *